US010537979B2

(12) United States Patent
Skross et al.

(10) Patent No.: US 10,537,979 B2
(45) Date of Patent: Jan. 21, 2020

(54) MOBILE WET ABRASIVE BLASTING SYSTEM UTILIZING AUTOMATED VALVES TO SIMPLIFY SETUP AND OPERATIONAL FUNCTIONS

(71) Applicant: FP GROUP, LLC, Philadelphia, PA (US)

(72) Inventors: John R. Skross, Wilmington, DE (US); Tim P. Kavka-Coogan, West Chester, PA (US); Adam H. Soles, Abington, PA (US)

(73) Assignee: CLEARBLAST, LLC, West Chester, PA (US)

( * ) Notice: Subject to any disclaimer, the term of this patent is extended or adjusted under 35 U.S.C. 154(b) by 121 days.

(21) Appl. No.: 15/685,347

(22) Filed: Aug. 24, 2017

(65) Prior Publication Data

US 2017/0348824 A1 Dec. 7, 2017

Related U.S. Application Data

(63) Continuation-in-part of application No. PCT/US2016/020569, filed on Mar. 3, 2016.
(Continued)

(51) Int. Cl.
*B24C 1/08* (2006.01)
*B24C 7/00* (2006.01)
(Continued)

(52) U.S. Cl.
CPC ..... *B24C 1/08* (2013.01); *B24C 1/086* (2013.01); *B24C 3/06* (2013.01); *B24C 5/04* (2013.01);
(Continued)

(58) Field of Classification Search
CPC .. B24C 1/08; B24C 1/086; B24C 3/06; B24C 5/04; B24C 7/0015; B24C 7/0023;
(Continued)

(56) References Cited

U.S. PATENT DOCUMENTS

D246,108 S 10/1977 Ashworth
5,024,029 A * 6/1991 Abbott ..... B24C 5/02 451/101
(Continued)

FOREIGN PATENT DOCUMENTS

KR 20010064216 7/2001

OTHER PUBLICATIONS

English Abstract of KR20010064216.
International Search Report for corresponding PCT Application No. PCT/US2016/020569 dated Jun. 15, 2016.

*Primary Examiner* — Robert A Rose
(74) *Attorney, Agent, or Firm* — Caesar Rivise, PC

(57) ABSTRACT

The invention is directed toward a mobile wet-abrasive blasting system used for cleaning, preparing surfaces, removing coatings, and other abrasive blasting applications. The wet abrasive basting system has a blast pot that includes pilot-controlled pneumatics to control the loading, pressurizing, de-pressurizing, and wash down functions. The wet-abrasive blasting system also uses a floating bung in conjunction with a vent mechanism to further automate the pressurizing steps in setting up the system. The wet-abrasive blasting system also uses pilot-controlled pneumatics to decide the blasting function options of just water, just air, or water/abrasive mix and air. Wet-abrasive blasting systems mix an abrasive media with water and convey the mix to meet compressed air and direct through a blast hose and nozzle.

24 Claims, 7 Drawing Sheets

Related U.S. Application Data

(60) Provisional application No. 62/129,206, filed on Mar. 6, 2015.

(51) Int. Cl.
*B24C 3/06* (2006.01)
*B24C 5/04* (2006.01)

(52) U.S. Cl.
CPC ..... *B24C 7/0015* (2013.01); *B24C 7/0023* (2013.01); *B24C 7/0038* (2013.01); *B24C 7/0076* (2013.01)

(58) Field of Classification Search
CPC ..... B24C 7/0038; B24C 7/0076; B24C 1/083; B24C 7/0084; B24C 3/04; B24C 3/062; B24C 3/12
USPC ..... 451/101
See application file for complete search history.

(56) References Cited

U.S. PATENT DOCUMENTS

D368,103 S 3/1996 Zwicker
D370,490 S 6/1996 Zwicker
D400,212 S 10/1998 Brassil et al.
6,099,395 A 8/2000 Guseman
6,224,463 B1 5/2001 Hartzell, Jr.
D459,370 S 6/2002 Beadel
D476,668 S 7/2003 Storer et al.
6,609,955 B1 8/2003 Farrow
D534,557 S 1/2007 Storer et al.
D634,759 S 3/2011 Farrow
D635,101 S 3/2011 Farrow
D635,162 S 3/2011 Johansen
D653,685 S 2/2012 Farrow
D659,595 S 5/2012 Eliason
D669,922 S 10/2012 Eliason
D706,317 S 6/2014 Eliason
D757,135 S 5/2016 Skross et al.
2003/0124955 A1 7/2003 Hanson
2003/0199232 A1 10/2003 Rivir et al.
2004/0092216 A1 5/2004 Publ et al.
2012/0015592 A1* 1/2012 Eliason ..... B24C 7/0038 451/91
2012/0135670 A1* 5/2012 Baer ..... B24C 3/325 451/102

* cited by examiner

MOBILE WET ABRASIVE BLASTING SYSTEM UTILIZING AUTOMATED VALVES TO SIMPLIFY SETUP AND OPERATIONAL FUNCTIONS

CROSS-REFERENCE TO RELATED APPLICATIONS

This bypass continuation-in-part application takes the benefit under 35 U.S.C. § 120 of PCT Application No. PCT/US2016/020569, filed on Mar. 3, 2016 which in turn claims the benefit under 35 U.S.C. § 119(e) of Application Ser. No. 62/129,206 filed on Mar. 6, 2015 all of which are entitled MOBILE WET ABRASIVE BLASTING SYSTEM UTILIZING AUTOMATED VALVES TO SIMPLIFY SETUP AND OPERATIONAL FUNCTIONS and all of whose entire disclosures are incorporated by reference herein.

BACKGROUND OF THE INVENTION

The present invention relates generally to cleaning devices and, more particularly, to wet abrasive blasting systems used for cleaning, preparing surfaces, removing coatings, and other abrasive blasting applications.

To remove corrosion or coatings from a substrate such as steel or concrete in order to restore, paint, or clean the substrate, cleaning systems are used. In certain applications, abrasive blasting systems should be able to clean or remove corrosion or coatings without damaging the underlying metal or other substrate. In other applications, a certain degree of surface roughness (called profile) may be desired to assure new paint or coating adhesion.

The use of dry, hard abrasives, such as those used in conventional sand blasting, may result in excessive surface roughness to the point of causing damage to the substrate. Typical blast materials are hard (6 to 9 on Mohs Scale of Mineral Hardness) and abrasive in order to increase the efficiency of the blasting operation. Soft blast materials (generally less than 6 on the Mohs scale), such as agricultural products which can include crushed walnut shells, rice hulls, corn cob, and pistachio shells, plastic or glass particles are sometimes used to reduce substrate surface damage. (See also U.S. Pat. No. 6,609,955 (Farrow), regarding a method for removing surface coatings).

FIG. 1 depicts a conventional current wet-abrasive system 1 that is used to reduce the amount of airborne dust and minimize surface damage, even while using hard abrasives. Wet-abrasive systems rely on a method to force a mixture of water and the abrasive media into the compressed air-stream in a controlled manner. In particular, a blast pot or pressure vessel 2 is manually charged with a liquid, typically water through a water inlet 4. The solid abrasive (not shown) is manually entered into the blast pot 2 via an opening 5 in the top the blast pot 2 and wherein this opening 5 is then manually sealed, using a standard bung assembly 16; as shown in FIG. 1, this bung assembly 16 is pulled up and manually held in place until enough pressure is built up in the blast pot 2, thus forming the water-media mixture 3 (also referred to as the "slurry") within the blast pot 2. The blast pot 2 is then manually purged of air via a first manual valve 6 (a second manual valve 6A is also provided for depressurizing the blast pot 2 when required). The blast pot 2 is fully pressurized with water provided via a pneumatic water pump 18 connected to the water inlet 4. The flow of pressurized water forces the slurry 3 out of the blast pot's slurry outlet 7 at a controlled rate and through piping 8 that is connected to the outlet 7; the piping 8 comprises a manual slurry valve 9 followed by a water injection port 10 (for use during a washdown process) which is then followed by a diaphragm valve 11. The piping 8 is connected a T-shaped manifold 12 having a first end 13 that is connected to a compressed air source 17 which is followed by a blast regulator 14. Thus, the flow of pressurized slurry 3 combines with the compressed air to form a three phase blasting stream of abrasive, water and air and directed through a blast output 15 into a blast hose (not shown) coupled to the blast output 15 and this blasting stream is directed with the blast nozzle (also not shown) to the surface (not shown) to be cleaned.

However, these manual procedures, if done incorrectly, can create inconsistent flow or air pressure in the mix and cause erratic behavior of the wet abrasive blasting system and an inefficient blasting process. Thus, there remains a need for a system and method for eliminating these manual procedures to provide a consistent and efficient wet abrasive blasting stream.

All references cited herein are incorporated herein by reference in their entireties.

BRIEF SUMMARY OF THE INVENTION

An apparatus for delivering a blast stream for cleaning surfaces or removing coatings is disclosed. The apparatus comprises: a blast pot adapted for receiving a fluid (e.g., water, or air, etc.) or fluid/solid (e.g., a hard or soft abrasive material, etc.) mixture therein and having an output port for delivering the fluid or fluid/solid mixture into a delivery conduit that is adapted to be coupled to a hose/nozzle assembly for dispensing the blast stream; a first plurality of valves (e.g., pilot-controlled valves) that control pressure and fluid within the blast pot and the dispensing of the fluid or fluid/solid mixture through the hose/nozzle assembly; a control panel having a second plurality of valves (e.g., pneumatic selector valves) coupled to the first plurality of valves that permit an operator to control operation of the first plurality of valves without having to manually operate each one of the first plurality of valves; and a cart having a housing, wherein the housing comprises the blast port, the first plurality of valves and the control panel such that the apparatus is mobile.

A method for delivering a blast stream for cleaning surfaces or removing coatings is disclosed. The method comprises: providing a blast pot adapted for receiving a fluid (e.g., water, or air, etc.) or fluid/solid (e.g., a hard or soft abrasive material, etc.) mixture therein and having an output port for delivering the fluid or fluid/solid mixture into a delivery conduit that is adapted to be coupled to a hose/nozzle assembly for dispensing the blast stream; coupling a first plurality of valves (e.g., pilot-controlled valves) to ports on the blast pot and wherein the plurality of valves control pressure and fluid within the blast pot and the dispensing of the fluid or fluid/solid mixture through the hose/nozzle assembly; positioning the blast pot with the first plurality of valves within a housing on a cart for making the blast pot mobile; coupling a control panel to the housing, wherein the control panel comprises a second plurality of valves (e.g., pneumatic selector valves) that are connected to the first plurality of valves; and operating, by an operator, the second plurality of valves to control operation of the first plurality of valves without having to manually operate each one of the first plurality of valves in order to deliver the blast stream.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1:
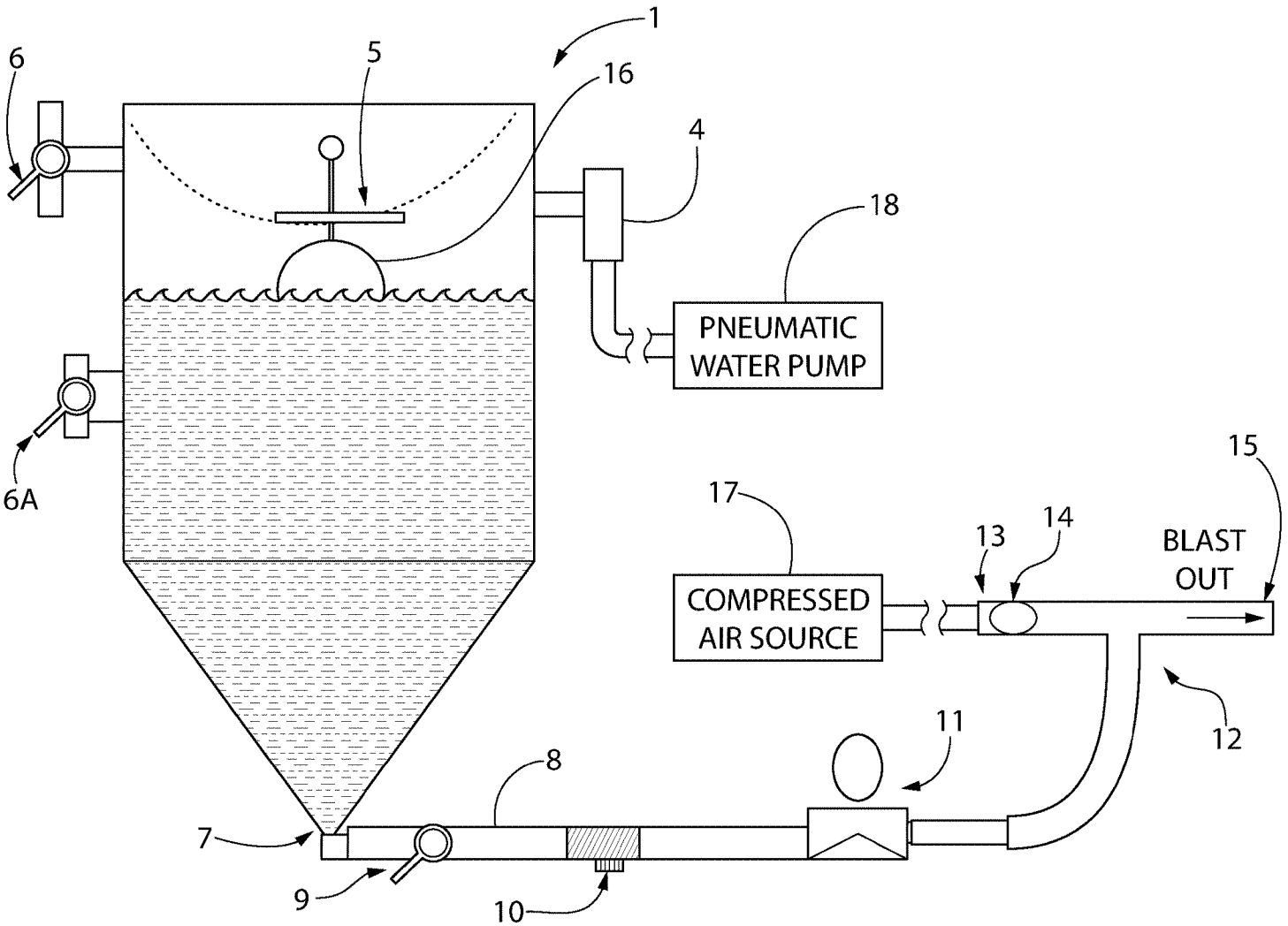
FIG. 1 (PRIOR ART)
FIG. 1 is a prior art wet-abrasive cleaning system that is used to reduce the amount of airborne dust while minimizing surface damage by using manually-operated ball valves that control the pressurizing, operation and depressurizing of the blast pot.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

As will be discussed in detail later, the invention of the present application is directed toward wet abrasive blasting systems used for cleaning, preparing surfaces, removing coatings, and other abrasive blasting applications. Embodiments of the wet abrasive basting system comprise of a series of pilot controlled pneumatics automating the basic and advanced functions in setting up, operating, and shutting down the system. The floating bung and vent assembly allow for the air to escape the pot allowing for the pot to pressurize without additional steps or human interaction. Wet-abrasive blasting systems mix an abrasive media with water and convey mix to meet compressed air and direct through a blast hose and nozzle.

Figure 2:
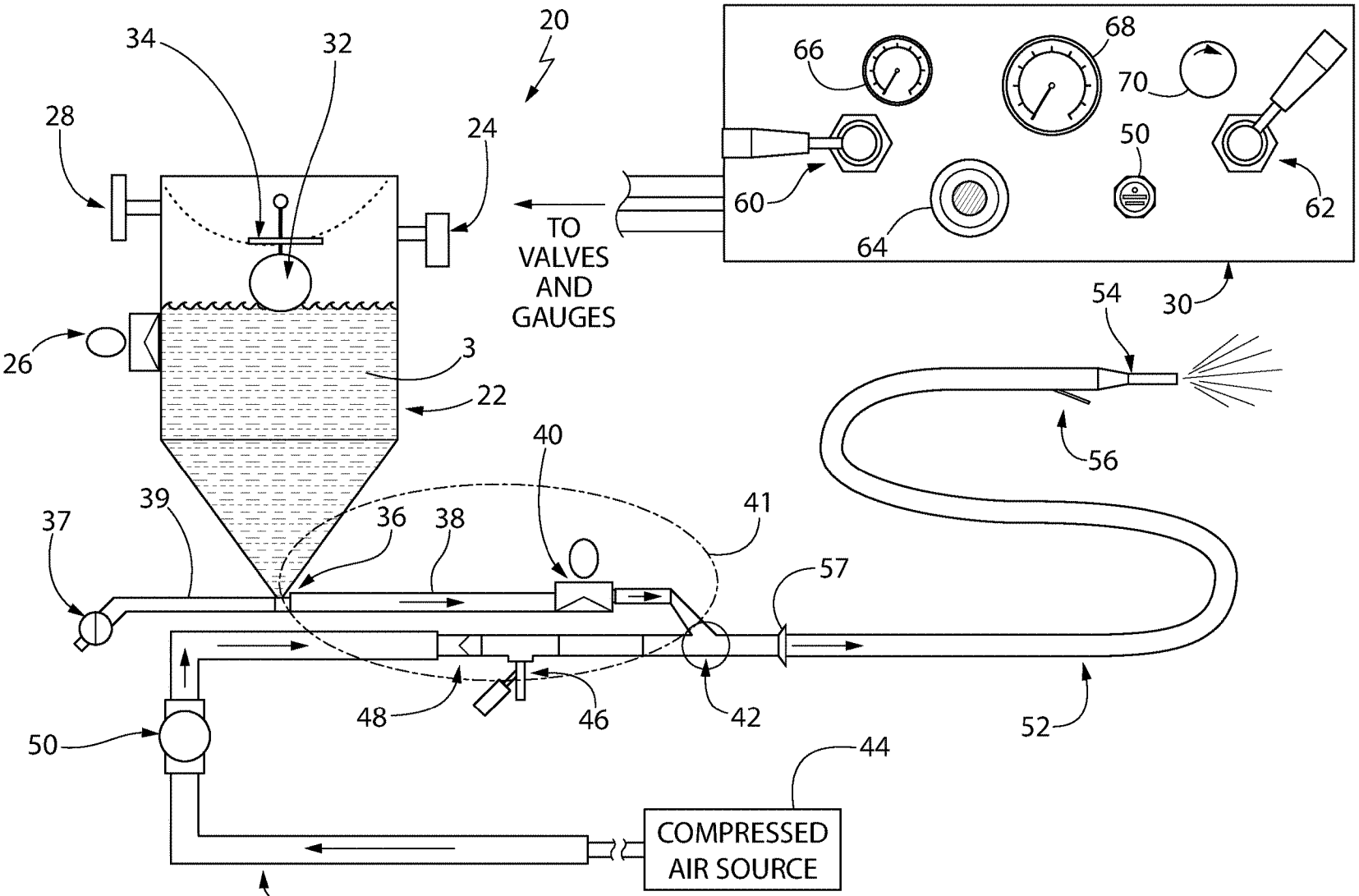
FIG. 2 is a functional diagram of the mobile wet abrasive blast system invention of the present application that incorporates pilot-controlled pneumatic ball valves or angled-seat valves, along with a floating bung and vent system to control loading, pressurizing, depressurizing, as well as blasting functions of media such as water-only, air-only or abrasive-air-water mixture.

FIG. 2 provides a functional diagram of the invention 20 of the present application. In particular, the invention comprises a blast pot 22 that includes a pressurized angle seat valve 24, a depressurizing diaphragm valve 26 and a vent 28, all of which are controlled a via control panel 30. The blast pot 22 includes a spherical bung 32 that floats on top of the slurry 3 (similar to the slurry discussed previously, comprising, for example, a water/media mixture) and is aligned with the blast pot vessel opening 34. The blast pot 22 comprises a slurry outlet 36 that is coupled to piping 38 which also comprises a diaphragm valve 40. The slurry outlet 36 is also coupled to piping 39 which includes a manual pot dump valve 37. The distal end of the piping 38 is coupled via a wye-fitting (FIG. 2) to a slurry air mix piping 42; the wye-fitting 42 provides for smoother flow when compared to the T-shaped manifold 12 in FIG. 1. The slurry air mix piping 42 is coupled to a compressed air source 44 through a manifold 45 that comprises a washdown (water only) angle seat valve 46, a check valve 48 and a blast regulator 50. Another end of the slurry air mix piping 42 is connected to a blast hose 52 which terminates in a blast nozzle 54. A blast trigger 56 (e.g., pneumatic "deadman" trigger device 10565 by Clemco) is positioned at the hose 52 end near the nozzle for activating the blast stream.

Several of the previously mentioned valves are pilot-controlled valves such as the depressurizing diaphragm valve 26 (e.g., a pilot-controlled pneumatic diaphragm valve 00142497 by Burkert Contromatic Corp.), the pressurized angle seat valve 24 (e.g., a pilot-controlled angle seat valve 2KS-3/8 valve by Sitzo Tech. Corp.), the washdown angle seat valve 46 (e.g., a pilot-controlled angle seat valve 2KS-3/8 valve by Sitzo Tech. Corp.) and the slurry diaphragm valve 40 (e.g., pilot-controlled pneumatic diaphragm valve 00142497 by Burkert Contromatic Corp.). These pilot-controlled valves (also referred to as "pilot-controlled pneumatics") are controlled by the control panel 30 for automating the basic and advanced functions in setting up, operating and shutting down the system 20. As such, the system 20 uses no electronics and is driven simply by pneumatics.

The floating spherical bung 32 and vent assembly 28 as shown in FIG. 2 allow for the air to escape the pot 22, thereby allowing for the pot 22 to pressurize without additional steps or human interaction. In a preferred embodiment, the pilot-controlled pneumatics are attached directly to the pot 22 and/or piping system 38/manifold 45. Alternatively, they may also be remotely-mounted based on location and serviceability.

Figure 3:
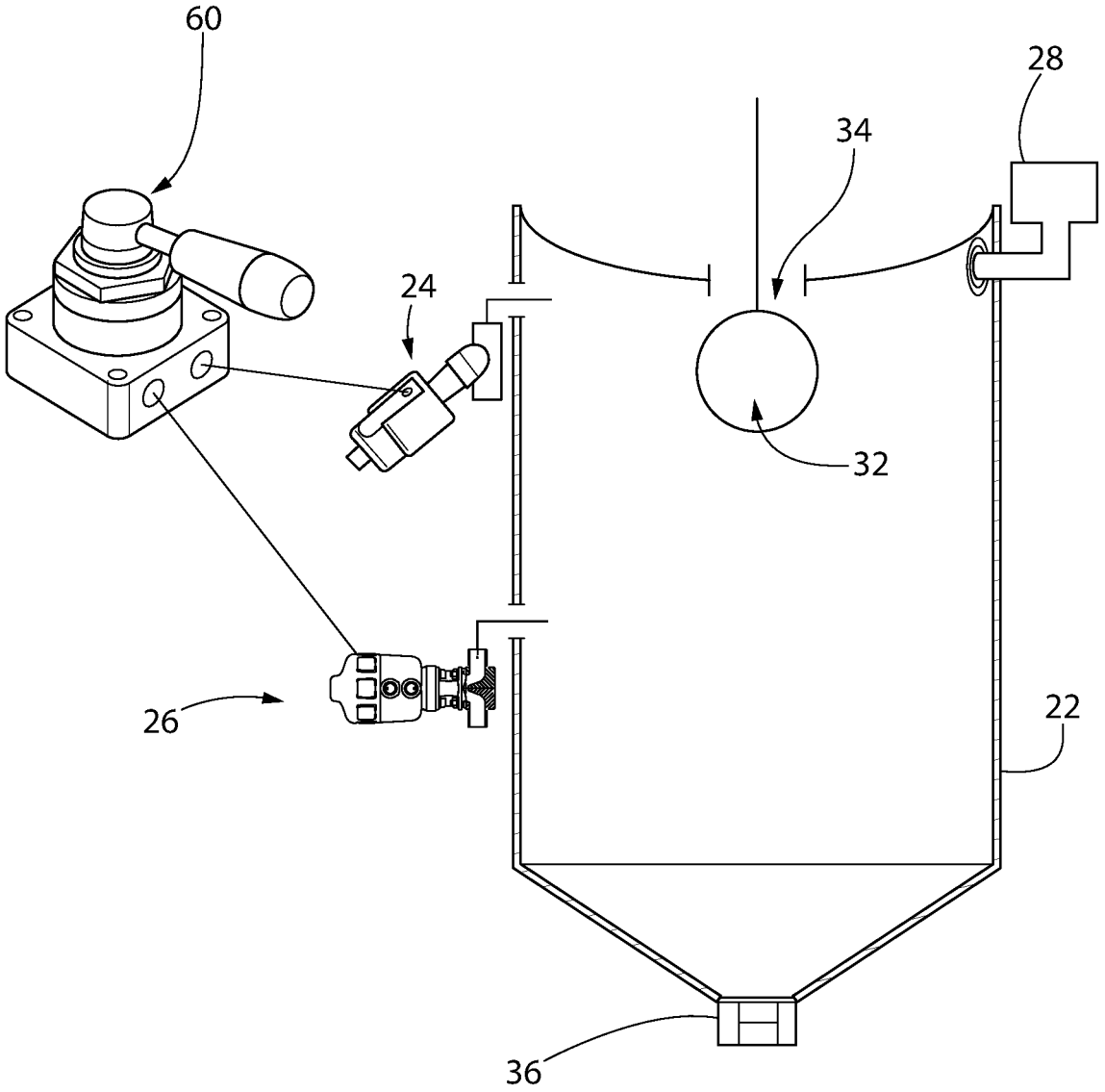
FIG. 3 is functional diagram depicting a selector valve that remotely controls a depressurizing diaphragm valve and a pressurizing angle seat valve.

In particular, embodiments of the wet abrasive blasting system 20 may comprise a vertically mounted pilot controlled pneumatic diaphragm valve 26 mounted to an opening on the side of the blasting pot 22 as shown in FIG. 2. The function of the valve 26 is to release the pressure and fluid, (e.g., water) from the blast pot 22 in order to make room and enable reloading of abrasive media for additional blast sessions. The function is remotely controlled by a pneumatic selector valve 60 (e.g., VH211-N02 hand selector valve by SMC Corp.) as shown in FIG. 3

Embodiments of the wet abrasive blasting system 20 may comprise a vertically mounted pilot controlled angle seat valve or ball valve 24, as shown in FIG. 2, allowing for fluid, (e.g., water), to fill the blast pot 22 and to push out remaining air and to pressurize the blast pot 22 to a predetermined pressure. The function is remotely-controlled by the pneumatic selector valve 60 as shown in FIG. 3. The functions of pressurizing, blasting, depressurizing are controlled remotely by a pneumatic selector valve 60, as shown in FIG. 3. The various positions of this valve 60 determine where pilot air is directed, namely to the pressurize valve 24 and depressurize valve 26 as shown in FIG. 2, thus eliminating the operator from manually controlling these valves and eliminating a substantial number of steps in order to operate the machine properly.

The blast pot 22 as shown in FIG. 2 may be of any design capable of storing the slurry 3 and maintaining the pressure of the system 20. As shown in FIG. 1, typical blast pots for wet abrasive blasting systems comprise cylindrical side walls and a conical shaped bottom leading to the bottom slurry outlet 36 of the blast pot 22 and into the wet abrasive piping system 38 as shown in FIG. 2, though other configurations may be used. The top and/or the bottom of the blast pot 22 may be any configuration such as, but not limited to, flat, round, conical, elliptical, inward sloping, basin shaped, or upward sloping.

The blast pot 22 may incorporate a "floating" bung assembly 32 allowing the pot 22 to fill and seal automatically by allowing the fluid, (e.g., water) and media 3 as shown in FIG. 2, to raise the bung 32 and seal the opening 34 in the top of the pot 22 as shown in FIG. 2 which is used for loading media 3 into the blast pot 22. As can be appreciated by FIG. 2, once the fluid level rises to a predetermined level such that the upper curvature of the bung 32 seats against the opening 34, the opening 34 is then sealed closed. The floating bung assembly 32 consists of, but not limited to, a high pressure stainless steel ball capable of sealing the pot 22 in excess of 250 psi. This floating bung 32 eliminates the manual step of sealing the blast pot 22 which is time consuming and can unnecessarily trap air in the blast pot 22. Once sealed, any excess air is expelled via the vent 28 as shown in FIG. 2 mounted near the top of the blast pot 22 to allow for proper pressurizing of the blast pot 22 to whatever pressure is desired and set by the operator.

The embodiment may include a pilot-controlled pneumatic ball or angle seat valve 46 mounted directly or remotely to the blasting pipe system 41 (comprising the piping 38 and diaphragm valve 40, and angle seat valve 46 and all of which are considered a "delivery conduit") as shown in FIG. 2, prior to the mixing of the blasting abrasive/water mix and compressed air (e.g., slurry air mix piping 42) as shown in FIG. 2. The function of this valve 46 is to inject a fluid, (e.g., water), into the blast stream in order to "wash down" the surface being blasted, as well as rinsing out the blast hose 52 prior to shutting down the system 20. The function of this valve 46 is remotely controlled by a pneumatic selector valve 62 (e.g., VH211-N02 hand selector valve by SMC Corp.) as shown in FIG. 4.

Figure 4:
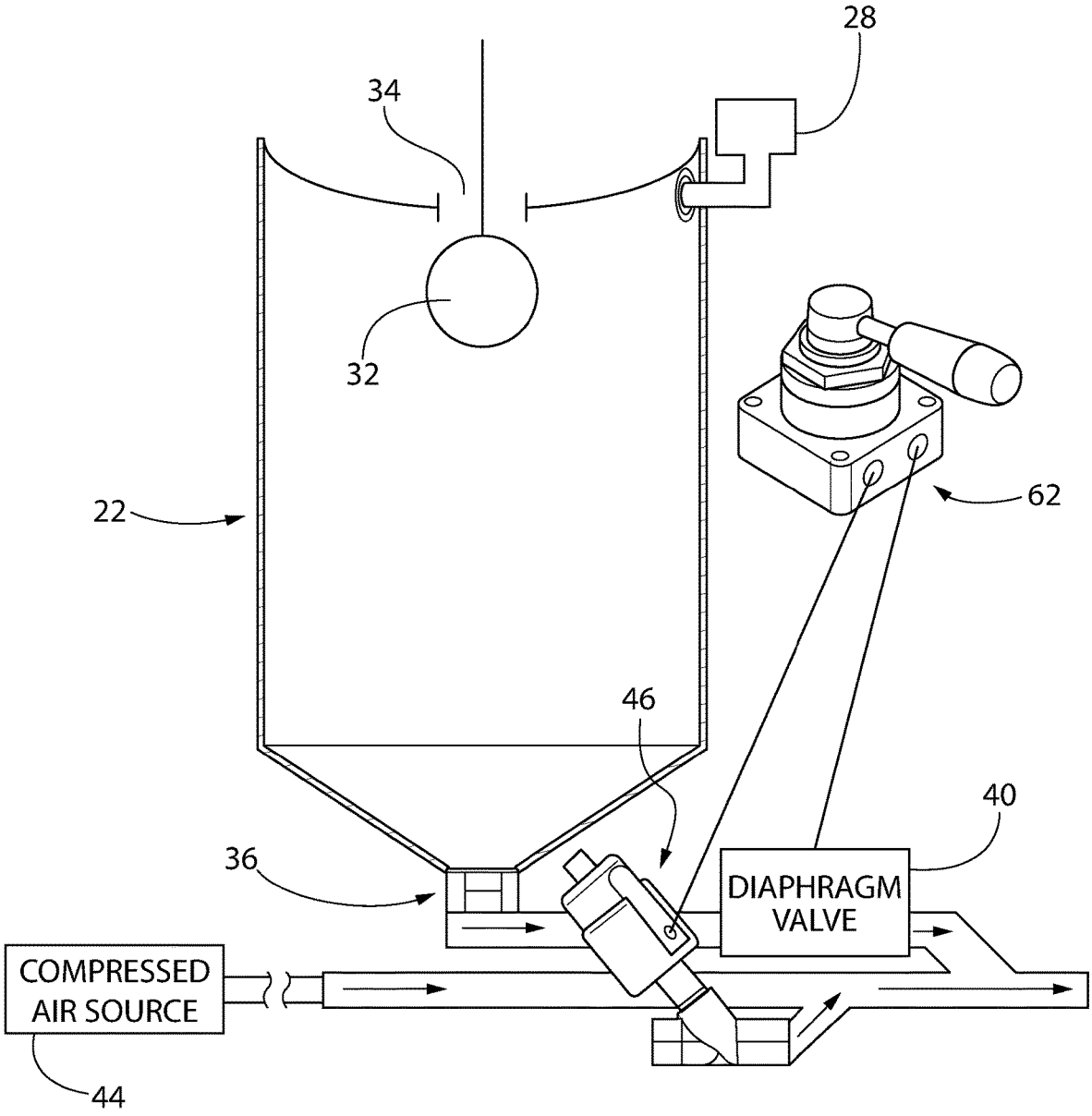
FIG. 4 is a functional diagram depicting another selector valve that remotely controls a washdown angle seat valve and a slurry diaphragm valve.

Determining what operation and/or series of actions takes place when the blast trigger 56 (e.g., 10565 device by Clemco) as shown in FIG. 2 is squeezed is determined by the pneumatic selector valve 62 as shown in FIG. 4. The valve 62, depending on its position, directs pilot air pressure to activate one of the following: the valve in 46 for blasting water only; the pilot-controlled pneumatic diaphragm valve 40 for blasting water/abrasive media mix and air; or neither, but rather for blasting only compressed air 44, as shown in FIG. 4.

Figure 5:
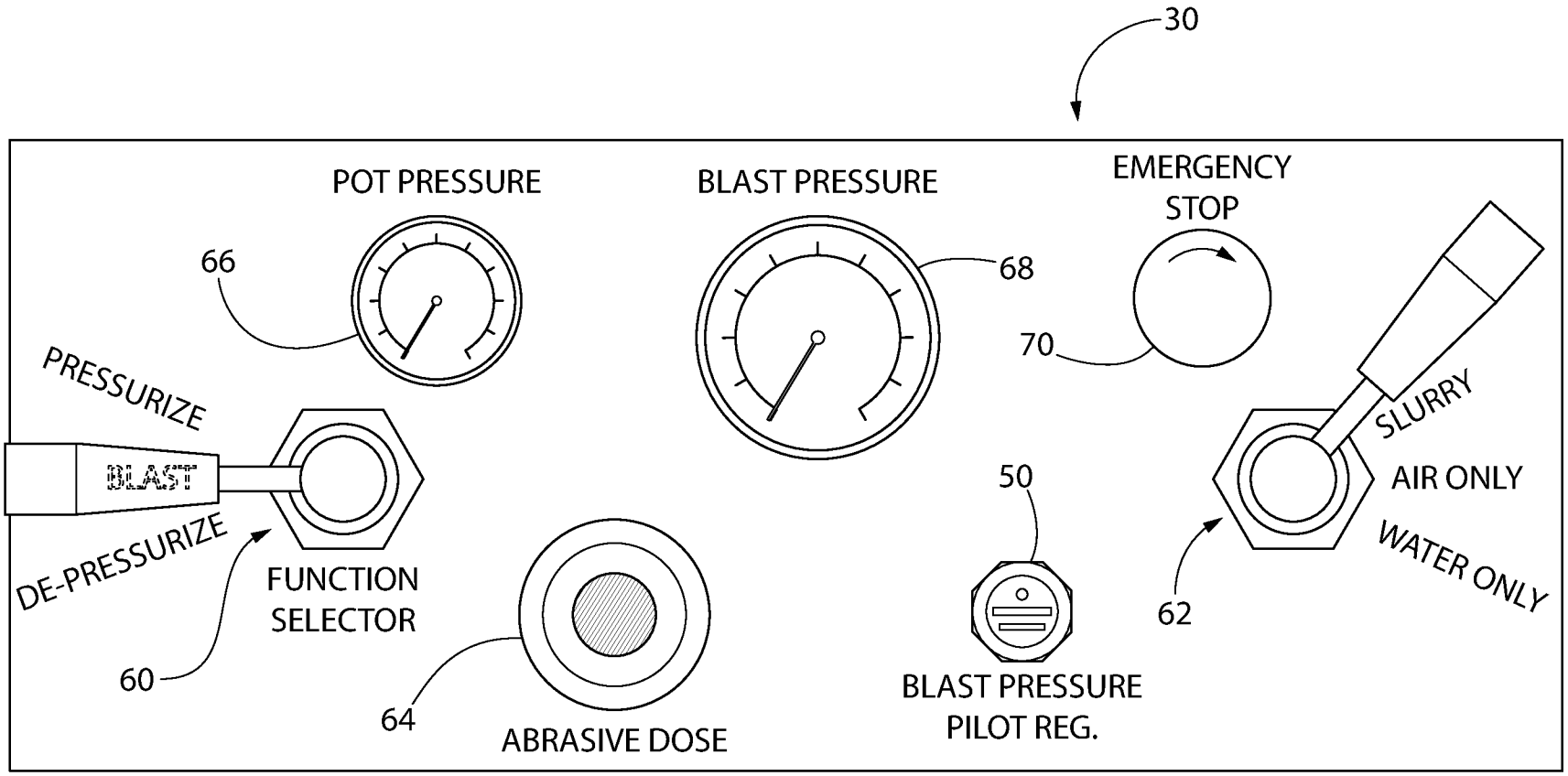
FIG. 5 is a plan view of a control panel of the present invention.

The functions and processes described in the embodiments above may be remotely consolidated into one control panel 30 as shown in FIG. 5, as to facilitate use of the invention 20 by the operator. This panel 30 includes, but not limited to, control valves (viz., the selector valves 60 and 62) as well as the blast pressure pilot regulator 50, abrasive dosing valve 64, pot pressure gauge 66, blast pressure gauge 68, and emergency stop switch 70 as shown in FIG. 5. By way of example only, the pneumatic selector valve 60 is shown positioned in the "blast mode" (the indicia "BLAST" being shown in phantom) while the pneumatic selector valve 62 is shown positioned in the SLURRY mode.

Figure 6A:
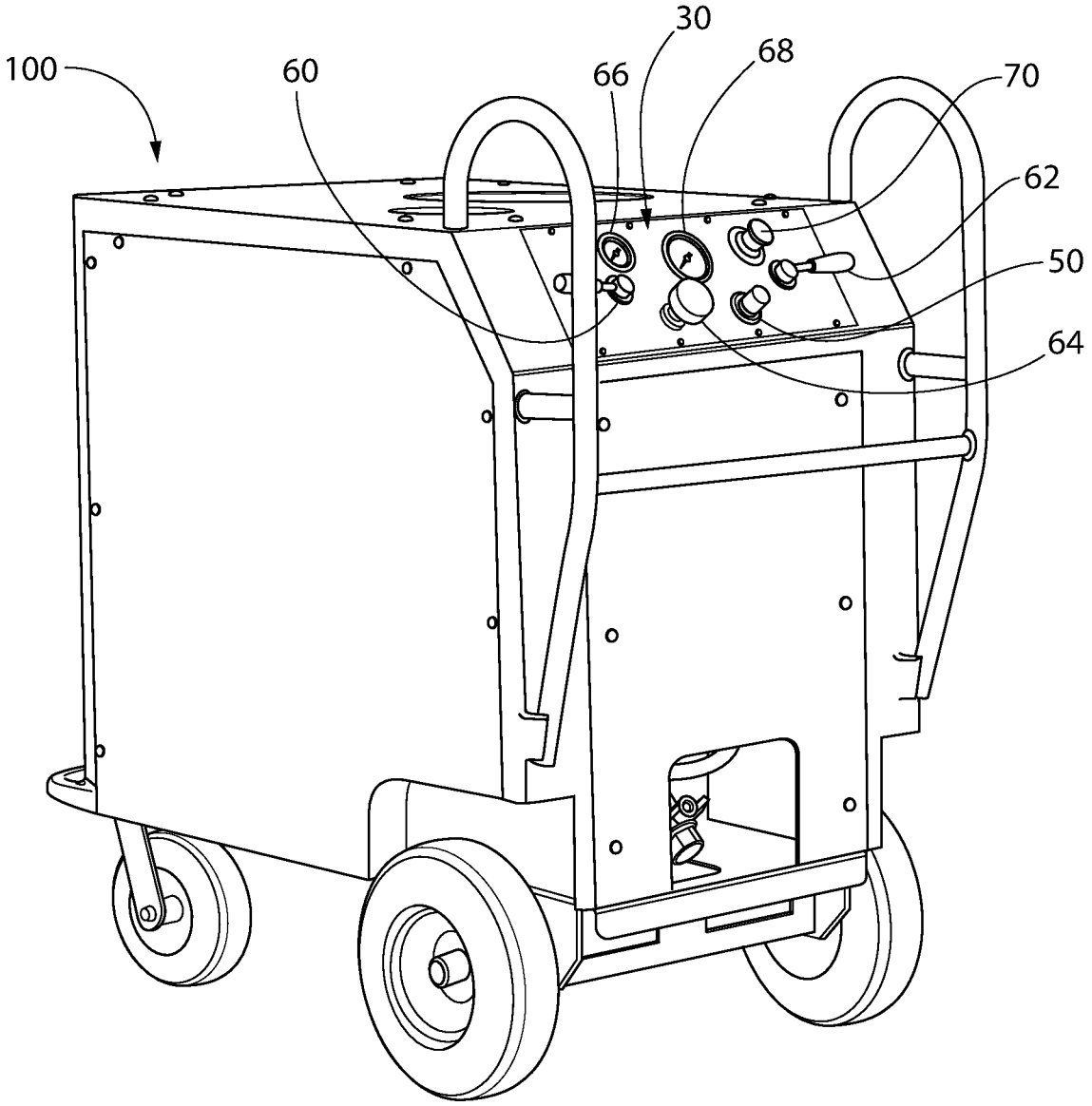
FIGS. 6A-6B are isometric front and back views of the cart of the present invention.
Figure 6B:
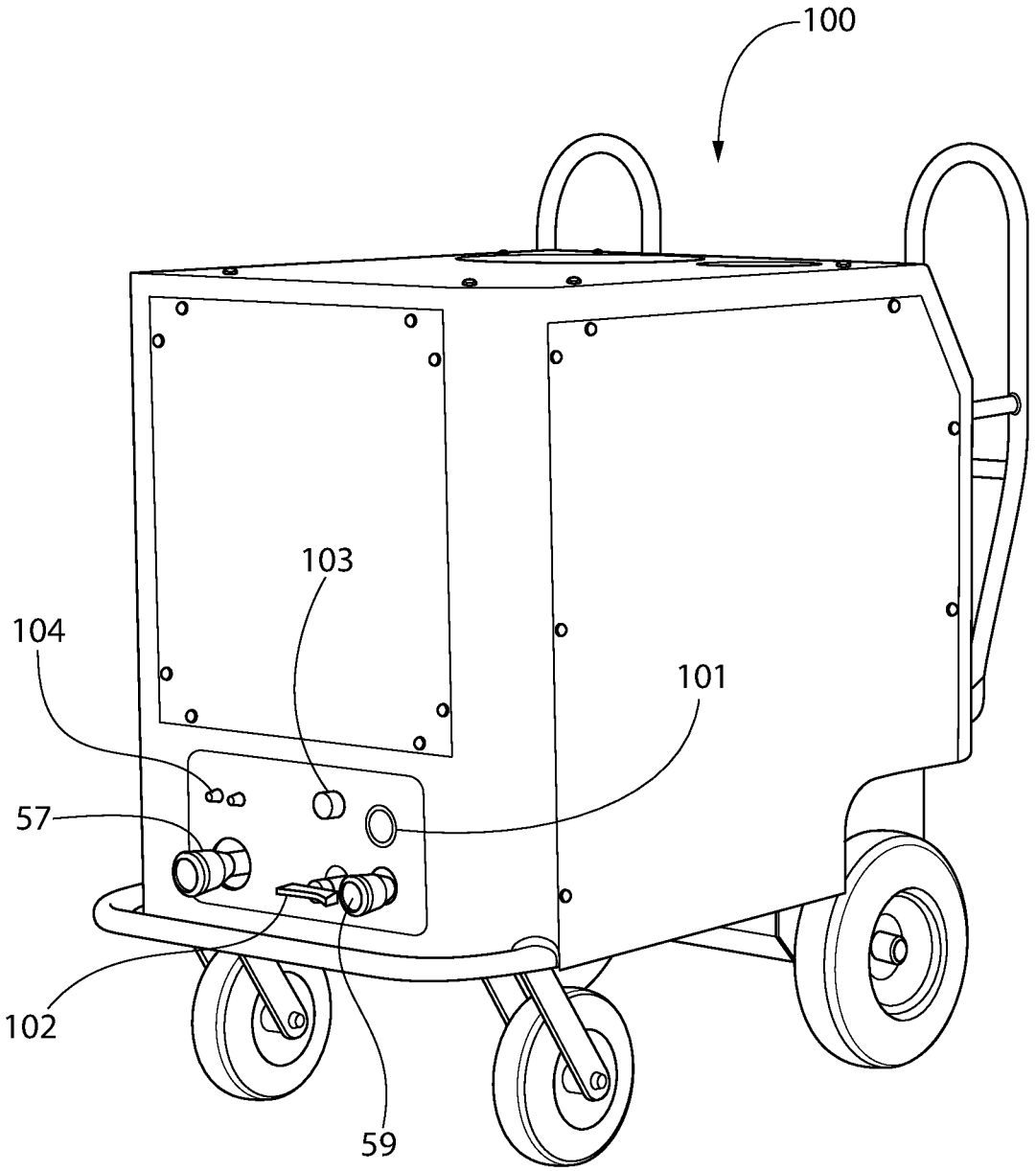

All of the components of the mobile wet abrasive blast system 20 are housed within an enclosure that is on wheels, thereby allowing the system 20 to be mobile. In particular, FIGS. 6A-6B provide front and back isometric views of the cart 100 upon which the present invention 20 is located. As can be seen in FIG. 6B, the external pneumatic connections are shown; in particular, there is a blast output fitting 57 to which the blast hose 52 is connected; a compressed air fitting 59 for coupling the pressurized air source 44; air input gauge 101 that permits operator to monitor air pressure level being delivered to invention 20; a water drain 102 fitting and a water input fitting 103 for draining and supplying water respectively to an onboard water reservoir (e.g., 25 gallon tank); and connections 104 for the deadman trigger device 56.

The mobile wet abrasive blast system 20 is thus designed based upon ease of use and simplicity. Automating the basic functions enable more novice operators to use wet-abrasive technology on a broader scale with less troubleshooting and problems that arise from traditional methods of manually operating valves in order to pressurize, fill and depressurize the system 20. As a result, the only manual aspect of the system 20 is the directing the blasting stream which may comprise water and abrasive mix, or water only, or air only. By incorporating pilot-controlled pneumatics for the pressurizing, loading, depressurizing, and blasting functions, this eliminates operator error and/or missed steps that typically result in poor operation, inconsistent blasting, abrasive media loss, lack of production, down time and system failure. By automating these functions, the system 20 allows for a substantially quicker setup and operation by an operator at any skill level and/or knowledge or lack of knowledge of wet-abrasive blasting. Furthermore, by automating functions, the system 20 also eliminates the need to readjust blast settings, especially during the reloading process. Blast settings (e.g., abrasive dosing 64 and abrasive blast pressure 50, as shown in FIG. 5) are set in the first blasting session and then can be maintained throughout the project because they do not need to be changed or adjusted between blasting sessions in contrast with standard wet-abrasive systems.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention 20, it will be understood that a number of components, parts, techniques and steps are disclosed. Each of these has individual benefit and each can also be used in conjunction with one or more, or in some cases, all of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claim.

While the invention has been described in detail and with reference to specific examples thereof, it will be apparent to one skilled in the art that various changes and modifications can be made therein without departing from the spirit and scope thereof.

What is claimed is:

1. A mobile apparatus for delivering a blast stream for cleaning surfaces or removing coatings, said apparatus comprising:

a blast pot adapted for receiving a liquid or liquid/solid mixture therein and having an output port for delivering said liquid or liquid/solid mixture into a delivery conduit that is adapted to be coupled to a hose/nozzle assembly for dispensing said blast stream;

a first plurality of valves that control pressure and liquid within said blast pot and the dispensing of said liquid or liquid/solid mixture through said hose/nozzle assembly;

a control panel having a second plurality of valves that are coupled to said first plurality of valves, said first plurality of valves being controlled only by said second plurality of valves on said control panel and which permits an operator to control operation of said first plurality of valves without having to manually operate each one of said first plurality of valves; and a cart having a housing, said housing comprising said blast pot, said first plurality of valves and said control panel such that said apparatus is mobile.

2. The apparatus of claim 1 wherein each one of said first plurality of valves is a pilot-controlled valve.

3. The apparatus of claim 2 wherein one of said first plurality of valves comprises an angle seat valve for pressurizing said blast pot.

4. The apparatus of claim 3 wherein one of said first plurality of valves comprises a diaphragm valve that depressurizes said blast pot.

5. The apparatus of claim 4 wherein one of said second plurality of valves comprises a pneumatic selector valve that permits an operator to select between said angle seat valve that pressurizes said blast pot and said diaphragm valve that depressurizes said blast pot.

6. The apparatus of claim 2 wherein one of said first plurality of valves comprises an angle seat valve coupled to said delivery conduit for blasting liquid only.

7. The apparatus of claim 6 wherein said apparatus is adapted to have a compressed air source coupled to said delivery conduit and wherein one of said first plurality of valves comprises a diaphragm valve coupled to said delivery conduit for blasting a liquid/solid mixture.

8. The apparatus of claim 7 wherein said one of said second plurality of valves comprises a pneumatic selector valve that permits an operator to select between said angle seat valve for blasting liquid only and said diaphragm valve for blasting a liquid/solid mixture.

9. The apparatus of claim 1 wherein said blast pot comprises an opening that is automatically closed off by a floating bung when a liquid level rises to a level in said blast pot that causes said floating bung to close off.

10. The apparatus of claim 1 wherein said hose comprises a "deadman's switch" that automatically discontinues blast stream once the operator releases said switch.

11. The apparatus of claim 1 wherein said liquid is water.

12. The apparatus of claim 1 wherein said solid in said liquid/solid mixture is an abrasive material.

13. A method for automating the operation of a wet abrasive blaster for delivering a blast stream for cleaning surfaces or removing coatings, said method comprising:

providing a blast pot adapted for receiving a liquid or liquid/solid mixture therein and having an output port for delivering said liquid or liquid/solid mixture into a delivery conduit that is adapted to be coupled to a hose/nozzle assembly for dispensing said blast stream;

coupling a first plurality of valves to ports on said blast pot and wherein said plurality of valves control pressure and liquid within said blast pot and the dispensing of said liquid or liquid/solid mixture through said hose/nozzle assembly;

positioning said blast pot with said first plurality of valves within a housing on a cart for making said blast pot mobile;

coupling a control panel to said housing, said control panel comprising a second plurality of valves that are connected to said first plurality of valves; and operating, by an operator, only said second plurality of valves at said control panel to control operation of said first plurality of valves without having to manually operate each one of said first plurality of valves in order to deliver the blast stream.

14. The method of claim 13 wherein each one of said first plurality of valves is a pilot-controlled valve.

15. The method of claim 14 wherein one of said first plurality of valves comprises an angle seat valve that pressurizes said blast pot.

16. The method of claim 15 wherein one of said first plurality of valves comprises a diaphragm valve for depressurizing said blast pot.

17. The method of claim 16 wherein one of said control valves comprises a pneumatic selector valve that permits an operator to select between said angle seat valve that pressurizes said blast pot and said diaphragm valve that depressurizes said blast pot.

18. The method of claim 14 wherein one of said first plurality of valves comprises an angle seat valve coupled to said delivery conduit for blasting liquid only.

19. The method of claim 18 wherein said step of coupling a first plurality of valves comprises coupling a diaphragm valve to said delivery conduit and also comprises coupling a compressed air source to said delivery conduit and wherein said step of operating comprises operating said diaphragm valve for blasting a liquid/solid mixture.

20. The method of claim 19 wherein said step of coupling a control panel comprises providing a pneumatic selector valve as part of said control panel for permitting the operator to select between said angle seat valve for blasting liquid only and said diaphragm valve for blasting a liquid/solid mixture.

21. The method of claim 13 further comprising the step of providing a bung that floats upon a liquid level in said blast pot and wherein said blast pot has on opening in a top portion, said floating bung automatically closing off said opening when said liquid level of said liquid, or of said liquid/solid mixture, rises to a predetermined level in said blast pot.

22. The method of claim 13 wherein said hose comprises a "deadman's switch" and wherein said step of delivering said blast stream is automatically discontinued once the operator releases said switch.

23. The method of claim 13 wherein said liquid is water.

24. The method of claim 13 wherein said solid in said liquid/solid mixture is an abrasive material.

* * * * *